US005940880A

United States Patent [19]

Phillips

[11] Patent Number: 5,940,880

[45] Date of Patent: Aug. 24, 1999

[54] APPARATUS AND METHOD FOR PROVIDING COOLANT WATER TO THE HEAD DURING EXERCISE

[75] Inventor: William T. Phillips, San Antonio, Tex.

[73] Assignee: Bio Targeting, Inc., San Antonio, Tex.

[21] Appl. No.: 08/989,495

[22] Filed: Dec. 12, 1997

[51] Int. Cl.[6] ..... A42B 3/00; A45F 3/20; B67D 5/54

[52] U.S. Cl. ..... 2/7; 2/422; 2/425; 2/181; 2/209.13; 224/148.2; 222/175; 222/386.5; 222/401

[58] Field of Search ..... 2/7, 422, 425, 2/171.2, 181, 205, 209.13; 224/148.2; 62/259.3, 304; 222/175, 386.5, 401; 4/616, 618

[56] References Cited

U.S. PATENT DOCUMENTS

| | | | |
|---|---|---|---|
| 4,526,298 | 7/1985 | Boxer et al. | 222/130 |
| 4,687,414 | 8/1987 | Wardy | 416/63 |
| 4,796,788 | 1/1989 | Bond | 222/94 |
| 4,807,813 | 2/1989 | Coleman | 239/153 |
| 4,813,083 | 3/1989 | Davidson | 2/422 |
| 4,911,339 | 3/1990 | Cushing | 222/610 |
| 4,998,415 | 3/1991 | Larsen | 62/231 |
| 5,054,122 | 10/1991 | Sher | 2/7 |
| 5,060,833 | 10/1991 | Edison et al. | 224/148 |
| 5,085,349 | 2/1992 | Fawcett | 222/175 |
| 5,143,390 | 9/1992 | Goldsmith | 280/201 |
| 5,197,292 | 3/1993 | McPherson | 62/56 |
| 5,370,278 | 12/1994 | Raynie | 222/175 |
| 5,438,707 | 8/1995 | Horn | 2/69 |
| 5,469,579 | 11/1995 | Tremblay et al. | 2/7 |
| 5,680,966 | 10/1997 | Johnson | 222/209 |
| 5,715,533 | 2/1998 | Stein | 2/7 |

*Primary Examiner*—Michael A. Neas
*Attorney, Agent, or Firm*—Kammer & Huff, PLLC

[57] ABSTRACT

A flexible water container carried on the back of the user in a position that does not restrict the active movement of the user during exercise. Connected to the water container is a tube to conduct the water from the container to an irrigation system positioned within a helmet or otherwise placed about the head of the user. A pressurized air bladder is positioned adjacent to the water container in a manner such that pressure within the air bladder has a tendency to force water from the water container into the tube and thus into the irrigation system. The air bladder is inflatable by means a hand pump connected to the bladder through a flexible tube. The irrigation system is constructed and configured so as to appropriately surround the head of the user and further includes a soft, flexible wick material worn about the head for the purpose of conducting water forced from the irrigation system evenly about the user's head.

6 Claims, 2 Drawing Sheets

APPARATUS AND METHOD FOR PROVIDING COOLANT WATER TO THE HEAD DURING EXERCISE

FIELD OF THE INVENTION

The present invention relates generally to devices for regulating the body temperature of individuals during exercise. The present invention relates more specifically to an apparatus and method for providing coolant water to the head of an individual wearing the device during exercise activities such as bicycling, running, and the like.

BACKGROUND OF THE INVENTION

There has always been a need for humans to provide themselves with a constant and consistent supply of water. This need is especially acute when the individual is engaged in exercise or other strenuous activity that requires the body's water supply to be replenished over a relatively short period of time. The body's need for water during exercise, and indeed during any type of physical activity, is basically two-fold in nature. First, the body utilizes water to carry out and facilitate almost all of the chemical reactions that occur in the body as it functions through movement and the exertion of force. Secondly, the body utilizes water as a mechanism for balancing its own temperature, again as a means for efficiently carrying out the chemical reactions that occur as it functions.

There are, therefore, two general concerns when addressing the requirements of the body for water during exercise or physical activity. These requirements center on the need to take water into the body by drinking and in most instances, to provide the body's skin surface with water for the purposes of temperature maintenance.

It is common knowledge that during exercise or physical activity the intake of water is essential for the body's healthy operation. The benefits of this water intake are most immediately seen in the body's efficient conversion of nutrients into the energy needed for motion and exertion and in the process of sweating, which has the effect of releasing from the body thermal energy that builds up during exertion. To the runner, bicyclist, or other participant in exercise activities, the process of sweating is the most apparent process whereby a replenishment of the body's water supply is needed. Equally apparent to the participant in strenuous activities is the need not only to drink water in order to continue the process of sweating and body temperature maintenance but also the process of dousing the skin with quantities of water for the same purpose. Participants in extremely demanding exercise activities quickly become aware that the body's own process of maintaining a thermal equilibrium through sweating is limited when the body is pushed to extremes. It quickly becomes evident that facilitating the body's thermal maintenance process by providing additional water for evaporation from the skin's surface operates to improve the well-being and efficiency of the individual exercising.

Not only it is apparent that dousing the body with water to facilitate the thermal maintenance process, helps in reaching maximum endurance, it is also apparent that certain parts of the body lend themselves better than others in this concern. It has been found that much of the body's ability to maintain a thermal equilibrium depends upon the release of heat from the head of the individual. This explains why runners, bicyclists, and the like, most frequently douse their heads with water through the use of cups or sponges while in the middle of a strenuous activity. It is not uncommon to see a race participant in a long distance running or bicycling event to receive water from a check point and both consume a portion and douse their bodies with the remaining portion. It is also quite common for such participants to pass through a water mist spray in order to fully cover their bodies with a healthy dose of external water. In either case, the body's ability to maintain a thermal equilibrium, the maintenance of which is essential for the healthy operation of the body at endurance levels, is of critical concern.

Many attempts have been made in the past to facilitate the drinking of water during exercise or other physical activities. These attempts have run the spectrum from simply providing containers with water that are readily accessible by the individual participating in the exercise or physical activity, to devices worn by the user and carried with them during the activity. One device that has come into common use is known under the trademark CAMEL BACK and was intended in its origin as a means for bicyclists to carry and access water without the problems associated with reaching for and handling a separate container. The CAMEL BACK device is described in a number of U.S. patents, most specifically U.S. Pat. No. 5,060,833. Basically, this type of water carrier comprises a flexible container worn on the user's back with a drinking tube directed from the container over the shoulder of the user to a position near the user's mouth where it is readily available for drinking. Certain valve structures in the tube permit the user to draw water from the container and not have it leak out when not in use. Various other attempts have been made in the field to provide water, either for the purposes of drinking or dousing the skin under exercise and physical activity situations. The following patents are among those in the art that address these concerns.

U.S. Pat. No. 4,526,298, issued to Boxer et al. on Jul. 2, 1985, entitled "Sport Hydration System," describes a liquid container suspended from the shoulders of the wearer. The system includes a liquid spraying device at the end of a tube connected to the liquid container.

U.S. Pat. No. 4,807,813, issued to Coleman on Feb. 28, 1989, entitled "Bicycle Mounted Water Toy," describes a device that includes a fluid reservoir for mounting to a bicycle. A first tube is connected to the fluid reservoir and to a pump for conveying fluid from the reservoir to a second tube that ends in a nozzle for dispersing the fluid. The nozzle of the second tube is attached to a helmet worn by the rider of the cycle.

U.S. Pat. No. 4,911,339, issued to Cushing on Mar. 27, 1990, entitled "Bicycle Water Pump," describes a water pump comprised of a pressurized cylindrical container, a hand operated valve integrally connected to a sprayer nozzle, and associated tubing, all which may be mounted on a bicycle. The internal pressure of the container is used to force a stream of liquid from the container toward the rider's mouth.

U.S. Pat. No. 5,085,349, issued to Fawcett on Feb. 4, 1992, entitled "Resilient Valve and Dispensing System for Bicyclists," describes a unitary valve apparatus held in a person's mouth for use in a system for delivering liquid from a container to the person's mouth. The valve is placed in the user's mouth so that it can be deformed by the user's jaws, thereby opening the valve in proportion to the force exerted thereagainst and enabling flow to occur from the supply chamber.

U.S. Pat. No. 5,197,292, issued to McPherson on Mar. 30, 1993, entitled "Cooling Cap for Athletes," describes a cap having an upper chamber that is accessible from the top by a zipper or other closure. The bottom of the chamber is made of a sponge-like material that serves to support a quantity of ice. This sponge-like material absorbs water from the melted ice and provides the coolant water to the wearer's scalp.

U.S. Pat. No. 5,370,278, issued to Raynie on Dec. 6, 1994, entitled "Portable Liquid Dispensing Toy," describes a device that sprays liquid from an outlet port mounted to a headband worn by the user. The device consists of a carrier and at least one storage reservoir secured to the user by a transport belt. Liquid is pumped through the relay hose from the reservoir to the discharge chamber and subsequently through the outlet port.

U.S. Pat. No. 5,060,833, issued to Edison et al. on Oct. 29, 1991, entitled "Camel Back," describes a back pack made of flexible material forming an enclosure for storage of liquid which is carried between the shoulders of a bicyclist. The enclosure includes a collapsible plastic water bag and flexible tubing which leads from the lower most part of the plastic water bag to a valve device. The valve is designed to be compressed between the user's jaws whereupon the valve opens to enable liquid to flow.

U.S. Pat. No. 5,054,122, issued to Sher on Oct. 8, 1991, entitled "Structure of Hat With Cooling System for the Head," describes a cooling hat comprised of a covering for the head with an internal peripheral channel for fastening or holding cooling elements and a ventilating socket. The cooling elements absorb heat and reduce surface temperature to comfort the head.

U.S. Pat. No. 4,998,415, issued to Larsen on Mar. 12, 1991, entitled "Body Cooling Apparatus," describes a device that includes a compressor and condenser which feed liquid coolant to a flexible tube network held adjacent the body. The flexible tube network is held in a lightweight vest or other garment so that the resulting apparatus permits movement.

U.S. Pat. No. 5,469,579, issued to Tremblay et al. on Nov. 28, 1995, entitled "Head Cooling Device," describes a device mounted over a person's head, comprised of a housing containing ice cubes therein, the main body being offset or spaced at all times from the scalp of the wearer; a means for enabling water droplets from the melting ice cubes to escape the housing toward the wearer's scalp; and a means for use with head gear to releasably anchor the housing to the head in an overhanging fashion.

U.S. Pat. No. 5,438,707, issued to Horn on Aug. 8, 1995, entitled "Body Cooling Apparatus," describes a garment that channels pressurized air or other compressible gases through a tubing network that is incorporated into a body garment worn by the user.

Unfortunately, most of the attempts at providing a mechanism for dousing the body with water fail to provide water to the most critical parts of the body for the maintenance of thermal equilibrium. This is particularly true in the instance of those involved in the activity of bicycle riding, which partially limits the user's ability to access containers of water with their hands, which are normally occupied with maintaining balance and steering on the bicycle. The CAMEL BACK product mentioned above satisfies the need to provide readily accessible drinking water to the bicycle rider but does not address the concerns associated with the usefulness of dousing the body's skin surface with water during exercise.

Other devices that are directed at providing the body's skin surface with water, such as the Cushing patent identified above, fail to adequately and efficiently provide such water. As is most frequently the case, bicycle riders operate with the use of helmets in a manner that prevents water sprayed from an external source from landing on the head in a way that it would be useful for the maintenance of the body temperature of the user. At most, devices such as described in Cushing provide a coolant effect to the face but even this process is inefficient in that much of the water is lost to the atmosphere around the user rather than falling on the user's skin. In addition, there is no method provided to hold the water in contact with the skin resulting in much of the water rapidly running off after being sprayed on the face.

It would be desirable, therefore, to have a device capable of dousing the body's surface with water in a manner that helps the body maintain its thermal equilibrium and at the same time to not require the user to be distracted from the exercise activity itself. It would be desirable that this device be efficient in that the reservoir containing such water need not be large as would be required by a device where a major portion of the water is lost to the atmosphere around the user. It would further be desirable that this device be directed to those portions of the body of the exerciser that have been shown to be most critically in need of the additional water for the purposes of eliminating heat from the body during exercise.

SUMMARY OF THE INVENTION

It is therefore an object of the present invention to provide a device for delivering coolant water to the surface of the skin of an individual during exercise or other strenuous activity.

It is a further object of the present invention to provide a device for delivering coolant water to the skin surface of an individual in a manner that requires little or no attention to the process by the user.

It is a further object of the present invention to provide a device for delivering coolant water to the skin surface of an individual engaged in exercise or other strenuous activity that is conveniently carried directly on the individual and conducts such water for use in a manner that does not interfere with the activity of the individual.

It is a further object of the present invention to provide a device for delivering coolant water to the skin surface of an individual engaged in exercise or other strenuous activity in a manner that reduces the amount of water lost to the environment through failure to contact the skin surface of the individual and thereby reduces the amount of water required to be carried by the individual for use.

It is a further object of the present invention to provide a device for delivering coolant water to the skin surface of an individual engaged in exercise or other strenuous activity, and more specifically to provide such water to the head of the user during such activity.

It is a further object of the present invention to provide a device for delivering coolant water to the head of an individual during exercise or other strenuous activity that is capable of being incorporated into helmets, caps, or other apparel devices worn by the user during such activity.

It is a further object of the present invention to provide a device for delivering coolant water to the skin surface of an individual during exercise or other strenuous activity that provides a constant flow of water with or without the direct control of the user.

It is a further object of the present invention to provide a device for delivering coolant water to the skin surface of an individual during exercise or other strenuous activity in a manner that is controllable by the user.

In fulfillment of these and other objectives, the present invention provides a flexible water container intended to be carried on the back of the user in a position that does not restrict the active movement of the user during exercise. Connected to the flexible water container is a tube designed to conduct the water from the container to an irrigation system positioned within a helmet or otherwise placed about the head of the user. A pressurized air bladder is positioned adjacent to the flexible water container in a manner such that pressure within the air bladder has a tendency to force water from the container into the tube and thus into the irrigation system. The air bladder is inflatable by means a hand pump connected to the bladder through a flexible air tube. The irrigation system of the present invention is constructed and configured so as to appropriately surround the head of the user and further includes a soft, flexible wick material intended to be worn about the head for the purpose of conducting water forced from the irrigation system evenly about the user's head and for retaining the water next to the skin to maximize cooling from evaporation and, depending upon the configuration of the wick material, down and about the user's neck. Consideration is given to the need for appropriate air flow in and about the irrigation system and the wick material to facilitate the coolant effect brought about by the evaporation of water next to the skin surface. Various other items of apparel are anticipated to be used in place of the helmet with appropriate adaptations of the irrigation system. Other objectives of the present invention will become apparent to those skilled in the art upon a reading of detailed specifications that follow and a consideration of the appended drawings and claims.

DETAILED DESCRIPTION OF THE PREFERRED EMBODIMENT

As indicated above, the present invention lends itself to use in conjunction with a variety of different exercising and sporting activities. A preferred embodiment of the invention is described as it might be constructed and used in conjunction with the activity of bicycle riding. It is understood that the fundamental concepts of the present invention could be similarly implemented in conjunction with a variety of different exercise and sporting activities.

Figure 1:
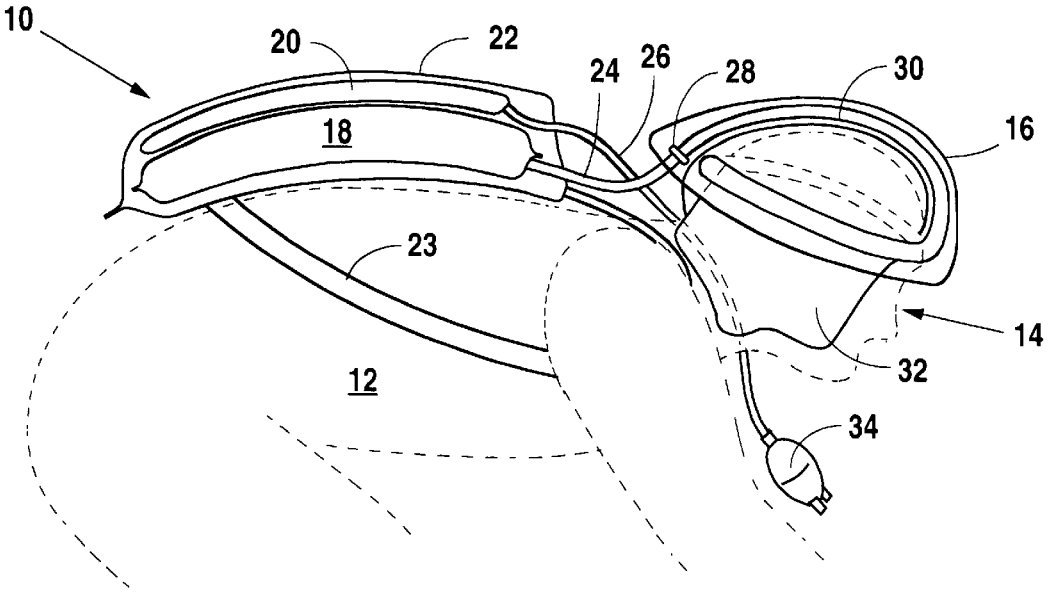
FIG. 1 is a schematic side view of the use of the present invention in conjunction with bicycle riding.

Reference is made first to FIG. 1 for a general description of the use of the present invention in conjunction with bicycle riding. In FIG. 1, coolant system (10) is carried by bicycle rider (12) in a manner much in the nature of a backpack. The primary components of coolant system (10), described in more detail below, are strapped to and rest in the center of the back of bicycle rider (12). The remaining components of the system are configured to surround the bicycle rider's head (14) in conjunction with a bicycle helmet (16).

Coolant system (10) is comprised primarily of water reservoir (18) that is positioned adjacent to air bladder (20), both of which are enclosed within envelope (22). This assembly is held against bicycle rider's (12) back by way of shoulder straps (23).

Connected to water reservoir (18) is water tube (24) which directs the coolant water from reservoir (18) to the system components situated about head (14) of bicycle rider (12). Air bladder (20) has an air conduit (26) that is directed over the shoulder of bicycle rider (12) to a point where inflation of air bladder (20) can be accomplished.

Water tube (24) is attached to the system components within helmet (16) by way of connector (28). Within helmet (16) is an array of irrigation tubing (30) that provides coolant water to head (14) of bicycle rider (12). Positioned between head (14) of bicycle rider (12) and irrigation array (30) is wick material (32).

Air conduit (26) drapes over the shoulder of bicycle rider (12) to a point where it terminates with hand pump (34) which falls in a position appropriate for bicycle rider (12) to inflate air bladder (20) through activation of hand pump (34). Hand pump (34) is a bulb type pump that typically incorporates a releasable valve that alternately allows air within bladder (20) to be released.

Figure 2:
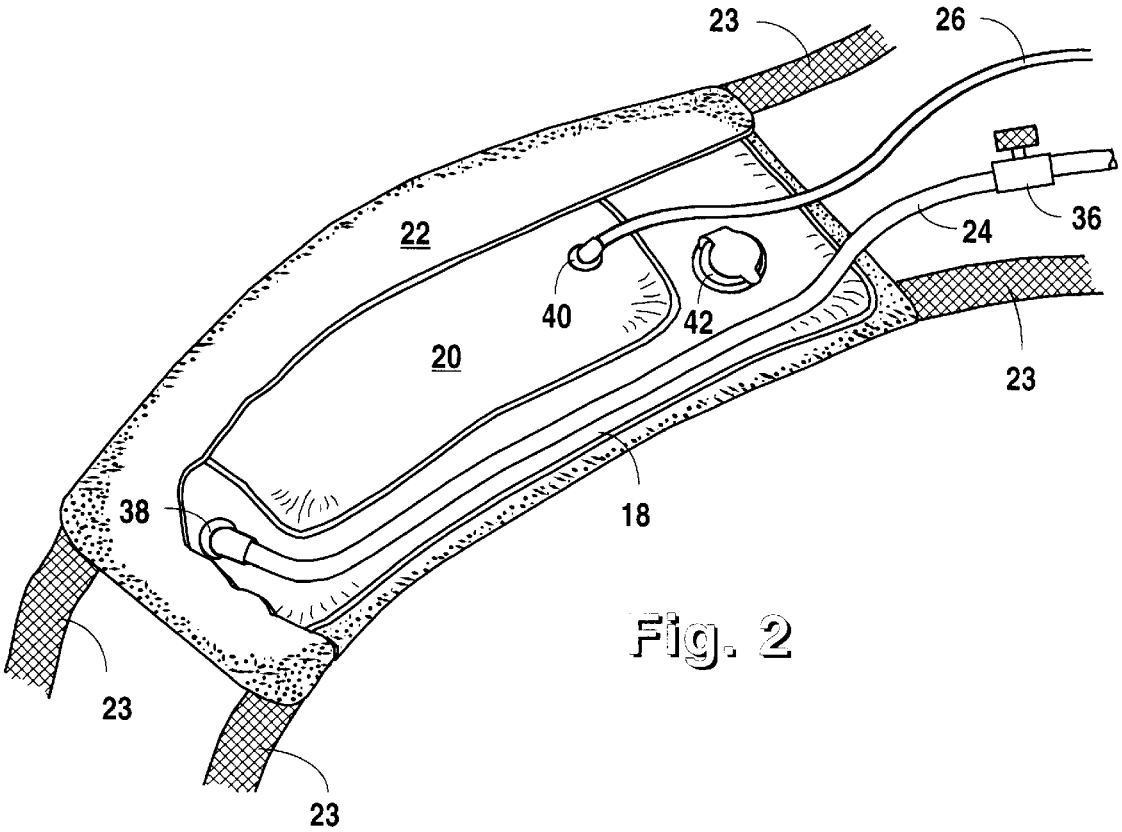
FIG. 2 is a partial cutaway perspective view of the device of the present invention showing the internal components.

Reference is now made to FIG. 2 for a more detailed description of the components of coolant system (10) that are carried on the back of bicycle rider (12). In this cutaway view shown in FIG. 2, envelope (22), with a plurality of straps (23), contains water reservoir (18) and air bladder (20) in parallel positions as shown. The size of water reservoir (18), air bladder (20), and envelope (22) are such that when air bladder (20) is inflated, pressure is placed on water reservoir (18) to the extent that water is forced from reservoir (18) for use. This requires envelope (22) to be constructed and sewn in a shape and size sufficient to tightly enclose both air bladder (20) and water reservoir (18) and to resist the expansion of air bladder (20) when it is inflated.

Serving to direct water from water reservoir (18) when such pressure is in place, is connector (38), which connects water tube (24) to water reservoir (18). In the preferred embodiment connector (38) is positioned at a base portion of water reservoir (18) to facilitate the complete use of water contained therein. A similar connector (40) is positioned on air bladder (20) and connects air conduit (26) for the purposes of inflating air bladder (20).

A shut-off valve (36) is provided to water tube (24) primarily for the purpose of preventing leakage from water reservoir (18) when it is refilled. After valve (36) is closed so as to prevent such leakage, water reservoir (18) may be filled with water by way of cap (42). Access to cap (42) is provided by way of an opening (no shown) in the top, sewn portion of envelope (22). In fact, the upper section of envelope (22) is generally left open not only for the purpose of refilling water reservoir (18) but for the complete removal of water reservoir (18) and air bladder (20) from envelope (22) when necessary. Alternatively, the upper section of envelope 3 (22) may be closed around the tubes with VELCRO™ material or the like. This facilitates the cleaning of all the components of the present system.

Figure 3:
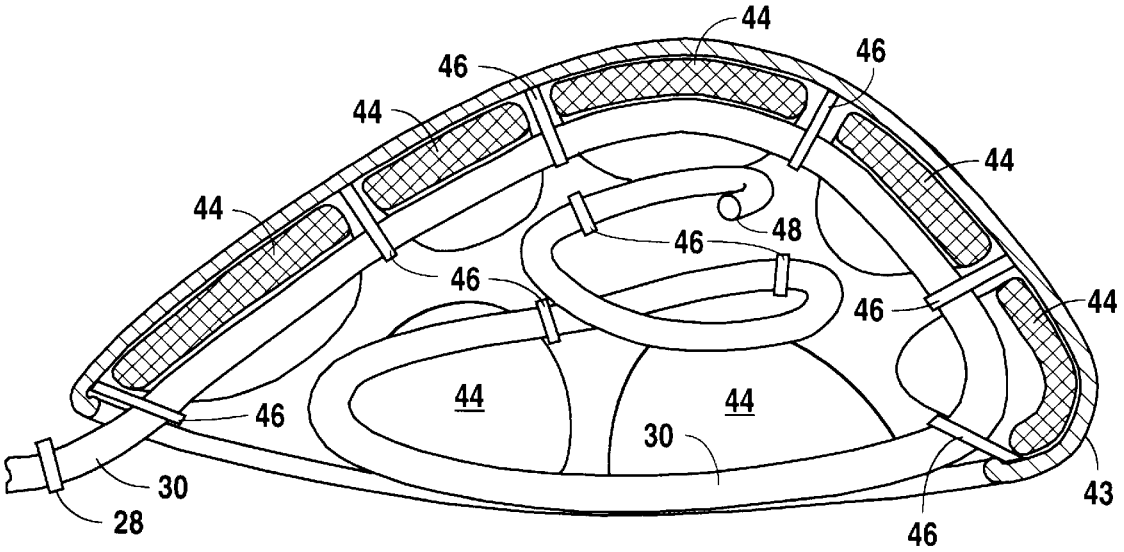
FIG. 3 is a partial cutaway side view of a bicycle helmet incorporating the components of the present invention.

Reference is now made to FIG. 3 for a detailed description of the components of the system of the present invention that are incorporated into the head gear worn by the user. In this case, a bicycle helmet is utilized to support and position the water dispensing components of the present invention. Helmet (16), shown in cross-section in FIG. 3, is generally comprised of outer shell (43) with a plurality of internal, spaced foam pads (44). Positioned appropriately around and between foam pads (44) is irrigation tubing (30) connected to water tube (24) (not shown in FIG. 3) by way of connector (28). Connector (28) allows helmet (16) to be released from the balance of the components of the system of the present invention.

Irrigation tubing (30) is attached to and held in place within helmet (16) by way of connectors (46). In the preferred embodiment connectors (46) could be plastic tie wraps or other such flexible straps connected to attachment points within helmet (16). Alternative means of attachment could include VELCRO™ type attachment surfaces or any other attachment mechanisms that do not project hard or uncomfortable components onto the head of the user. It is anticipated that irrigation tubing (30) could be incorporated into a variety of different bicycle helmets or other wearing apparel in a retrofit fashion, or could be constructed in an originally designed helmet or wearing apparel specifically configured to receive such irrigation tubing. In any event irrigation tubing (30) enters helmet (16) at a point adjacent the back of the helmet and terminates at some point with a closed cap (40) at an internal position within helmet (16).

Figure 4:
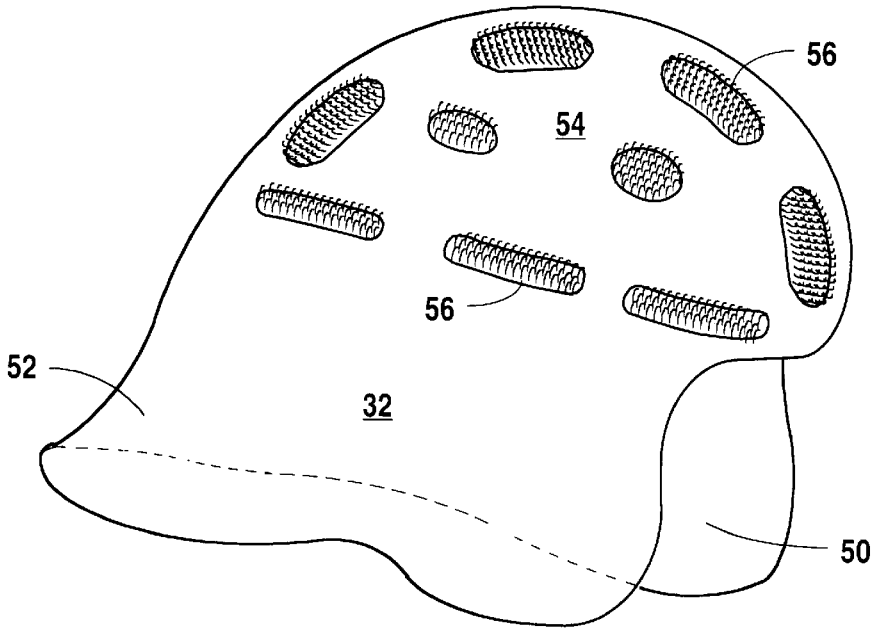
FIG. 4 is a perspective view of the wick material utilized in conjunction with the helmet structure shown in FIG. 3.

Reference is now made to FIG. 4 for a detailed description of the wicking material associated with use of the present invention. While irrigation tubing (30) shown in FIG. 3 could provide the necessary distribution of coolant water to the head of the user, it is preferable to incorporate an additional layer of wicking material (32) between the head of the user and irrigation tubing (30). Wicking material (32) not only provides a smooth surface with which the head of the user comes in contact within helmet (16) but also provides a means for more evenly distributing coolant water about the head and face of the user and holding the water in contact with the skin for effective evaporation. Wicking material (32) is comprised of a pair of sections (50) that draw coolant water down from the irrigation system of the present invention to the sides of the face of the user. In addition, section (52) of wicking material (32) draws such coolant water down to the neck of the user. Section (54) of wicking material (32) provides sufficient distribution of the coolant water over the top and forehead sections of the head of the user and holds water next to the skin in these areas.

Incorporated on the outside surface of wicking material (32) are attachment means (56). In the preferred embodiment attachment means (56) are one-half of a hook and pile (VELCRO™) type attachment system that serves to retain wicking material (32) within helmet (16). Matching with attachment means (56) shown on wicking material (32) are complimentary attachment components positioned appropriately within helmet (16). As with the attachment means for irrigation tubing (30), a variety of mechanisms for attaching wicking material (32) within helmet (16) are contemplated. The only requirement is that these attachment means not provide rigid or otherwise uncomfortable components to the interior of helmet (16) that would interfere with the wearing of the helmet by the rider. A variety of soft fabric attachment ties and the like are also possible depending upon the structure of helmet (16) or the other item of head apparel. It is anticipated, for example, that wicking material (32) could be integrally sewn into a fabric hat or cap in place of the more rigid helmet (16) described in the case of the preferred embodiment.

Use of the system of the present invention comprises filling water reservoir (18) by way of cap (42) and closing cap (42) to retain water therein. During this filling process, valve (36) is normally kept closed to prevent unintentional leakage of water from water reservoir (18). Air bladder (20) is then inflated by use of hand pump (34) positioned over the shoulder of the bicycle rider. Inflation of air bladder (20) places pressure on the water in water reservoir (18) so that it is forced from reservoir (18) through water tube (24). As long as valve (36) is maintained closed, no water flows into the irrigation components of the present invention. Once the rider is ready to utilize the system, valve (36) is opened and water will begin to flow into the irrigation components. As long as there is pressure in air bladder (20), a constant flow of water will occur.

Irrigation tubing (30) could be constructed of any of a number of different well-known irrigation structures. Plastic tubing with a plurality of small apertures could serve the purposes of the present invention quite well. A variety of hose materials are known in the field that operate much like a sponge in evenly distributing water conducted therethrough. Various types of irrigation tubing are well-known in the drip irrigation field and based upon the use of an appropriate size tube are easily adaptable for use in conjunction with the present invention.

The user of the system places wicking material (32) over the head to insure a comfortable fit and the appropriate positioning of the various sections of the material. Helmet (16) is then placed over wicking material (32) in a manner that fasteners (56) securely hold wicking material (32) within helmet (16) and keep it from being displaced during use.

It is anticipated that the pressure created by air pumped into air bladder (20) will be diminished before the full quantity of water is dispensed from water reservoir (18). For this reason it is anticipated that the user will be required to further inflate air bladder (20) during use through the operation of hand pump (34). This is why the positioning of hand pump (34) is made convenient for the user during the activity.

The flow rate of water from water reservoir (18) can be controlled to some extent by the level of air pressure within air bladder (20) and to some extent by the degree to which valve (36) is opened. In a preferred embodiment of the present invention, valve (36) could be structured to provide a range of flow rates rather than a simple on-off condition. In this manner, full pressurization of air bladder (20) would not result in an overly rapid dispensing of water from water reservoir (18). The rate at which water is dispensed through the irrigation components of the present invention is, of course, dependent upon the length and porosity of the irrigation components. The use of quarter-inch diameter irrigation tubing of the type typically used in conjunction with drip irrigation systems for gardening and the like, in an overall length of approximately two feet, position within the helmet of the user has been shown to provide an adequate but not excessive flow of water from water reservoir (18) when air bladder (20) is pressurized repeatedly. Such an arrangement provides an adequate coolant flow for as much as two to three hours of exercise without the need to refill water reservoir (18).

As indicated above, it is anticipated that use of the basic concepts of the present invention could be implemented in conjunction with a variety of sporting events, exercise, work, and military activities. Any activity that permits the user to carry the water and air reservoirs on the back and allows for a conduit to carry the coolant water to the head of the user by way of some type of wearing apparel for the head are possible. A runner, for example, could utilize the basic system of the present invention as described above substituting a lightweight cap made of fabric in place of the hard shell bicycle helmet described above. Appropriate modifications to a fabric cap could be made to incorporate not only the irrigation tubing necessary for the system but also the wicking material described. The size of the tubing could be reduced for such systems with a corresponding increase in the length of the irrigation conduit to provide the same quantity of coolant water flow. In addition, a variety of irrigation arrays could be configured within the wearing apparel for the head to adjust for the size and porosity of the tubing itself.

Other applications of the basic concept of the present invention are anticipated with a variety of sporting events, exercise, work, and military activities. It is believed that these applications and specific structural modifications required for the implementation will be become apparent to those skilled in the art.

I claim:

1. An apparatus for providing coolant water to the head of a user during exercise or other strenuous activity, comprising:

a water bladder, said water bladder having flexible walls that collapse when empty to form a generally flat profile;

an air bladder, said air bladder having flexible walls that collapse when empty to form a generally flat profile, said air bladder positioned in parallel planar orientation with said water bladder;

a flexible envelope, said flexible envelope configured to receive said water bladder and said air bladder in said parallel planar orientation through an opening on a first end of said envelope, said envelope further configured to restrict expansion of said air bladder and said water bladder when each of said bladders are filled;

an irrigation conduit, said conduit positioned about the head of said user in a manner that permits flow of watertherefrom onto the head of said user;

a water conduit connecting said water bladder to said irrigation conduit; and means for pressurizing said air bladder; wherein pressurization of said air bladder forces water from said water bladder through said water conduit into said irrigation conduit in a manner that dispenses water from said irrigation conduit onto the head of said user.

2. The apparatus of claim 1 further comprising wicking material positioned between said irrigation conduit and the head of said user, said wicking material serving to evenly distribute water dispensed from said irrigation conduit about the head of said user.

3. The apparatus of claim 1 wherein said flexible envelope is configured with straps in a manner that permits the carrying of said envelope and said water bladder with said air bladder on the back of said user.

4. The apparatus of claim 1 wherein said irrigation conduit is retained within a rigid helmet positioned on the head of said user.

5. The apparatus of claim 1 wherein said irrigation conduit is retained within a flexible cap positioned on the head of said user.

6. The apparatus of claim 1 wherein said means for inflating said air bladder comprises a bulb hand pump connected to an air conduit connected to said air bladder, said hand pump having a release valve associated therewith.

* * * * *

UNITED STATES PATENT AND TRADEMARK OFFICE

CERTIFICATE OF CORRECTION

PATENT NO. : 5,940,880

DATED : August 24, 1999

INVENTOR(S) : William T. Phillips

It is certified that error appears in the above-identified patent and that said Letters Patent is hereby corrected as shown below:

Column 10 Line 3 watertherefrom should read water therefrom

Signed and Sealed this

Twenty-ninth Day of February, 2000

*Attest:*

Q. TODD DICKINSON

*Attesting Officer*

*Commissioner of Patents and Trademarks*